US008272482B2

(12) United States Patent
Takahashi et al.

(10) Patent No.: US 8,272,482 B2
(45) Date of Patent: Sep. 25, 2012

(54) ELEVATOR APPARATUS FOR BRAKING CONTROL OF CAR ACCORDING TO DETECTED CONTENT OF FAILURE

(75) Inventors: Satoru Takahashi, Tokyo (JP); Takaharu Ueda, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 427 days.

(21) Appl. No.: 12/601,148

(22) PCT Filed: Jun. 14, 2007

(86) PCT No.: PCT/JP2007/062004

§ 371 (c)(1),
(2), (4) Date: Nov. 20, 2009

(87) PCT Pub. No.: WO2008/152722

PCT Pub. Date: Dec. 18, 2008

(65) Prior Publication Data

US 2010/0155183 A1 Jun. 24, 2010

(51) Int. Cl.
*B66B 1/34* (2006.01)

(52) U.S. Cl. ..... 187/393; 187/288

(58) Field of Classification Search ..... 187/277, 187/288, 391–393, 316, 354
See application file for complete search history.

(56) References Cited

U.S. PATENT DOCUMENTS

| | | | | |
|---|---|---|---|---|
| 4,975,627 | A * | 12/1990 | Reddy | 318/372 |
| 5,247,140 | A * | 9/1993 | Iwasa et al. | 187/288 |
| 7,740,110 | B2 * | 6/2010 | Kattainen et al. | 187/288 |
| 2009/0229924 | A1 * | 9/2009 | Kondo et al. | 187/288 |
| 2009/0236184 | A1 * | 9/2009 | Ueda et al. | 187/247 |
| 2010/0032245 | A1 * | 2/2010 | Shibata et al. | 187/288 |
| 2010/0038185 | A1 * | 2/2010 | Kattainen et al. | 187/288 |
| 2010/0044159 | A1 * | 2/2010 | Okamoto et al. | 187/288 |
| 2010/0051391 | A1 * | 3/2010 | Jahkonen | 187/393 |

FOREIGN PATENT DOCUMENTS

| | | |
|---|---|---|
| JP | 57 85779 | 5/1982 |
| JP | 61 229786 | 10/1986 |
| JP | 8 40658 | 2/1996 |
| JP | 9 240936 | 9/1997 |
| JP | 2000 247552 | 9/2000 |
| JP | 2000 255431 | 9/2000 |
| JP | 2003 81543 | 3/2003 |
| JP | 2005 343602 | 12/2005 |
| WO | 2004 050523 | 6/2004 |
| WO | 2006 090470 | 8/2006 |

* cited by examiner

*Primary Examiner* — Anthony Salata
(74) *Attorney, Agent, or Firm* — Oblon, Spivak, McClelland, Maier & Neustadt, L.L.P.

(57) ABSTRACT

An elevator apparatus performing proper braking control of a car according to a detected content of a failure, and including: a semiconductor switch connected in series to a brake coil, for varying current flowing through the brake coil; an interruption switch connected in series to the brake coil and the semiconductor switch and capable of interrupting current flowing through the brake coil; a braking force control processing mechanism controlling an amount of current flowing through the semiconductor switch according to deceleration of the car when the car stops; a failure detection section detecting failure in the braking force control processing mechanism; a critical event detection mechanism detecting a critical event requiring an urgent stop of the car based on a state detection signal; and a brake power supply interrupting mechanism turning the interruption switch OFF to apply braking when the failure and the critical event is detected.

8 Claims, 3 Drawing Sheets

ELEVATOR APPARATUS FOR BRAKING CONTROL OF CAR ACCORDING TO DETECTED CONTENT OF FAILURE

TECHNICAL FIELD

The present invention relates to an elevator apparatus having a function of controlling a braking force when an elevator is stopped, which ensures, even when a failure relating to the function of controlling the braking force is detected, braking control of a car according to a detected content of the failure.

BACKGROUND ART

In conventional elevator apparatuses, there are used a plurality of control systems, each of which compares its own input/output and results of calculation with those of the other system. If a difference obtained as a result of the comparison is out of an allowable error range, the control systems judges that a failure occurs in any of the systems to stop a control operation of an elevator (for example, see Patent Document 1).

Moreover, there is a safety control device for railways, in which each of control systems includes a healthy circuit for outputting a signal indicating whether its own system is in a normal state or a faulty state. When the signal indicating the faulty state is output from any of the healthy circuits, control operations of all the systems are stopped (for example, see Patent Document 2).

Patent Document 1: JP 2005-343602 A

Patent Document 2: JP 2000-255431 A

DISCLOSURE OF THE INVENTION

Problem to be Solved by the Invention

However, the related art has the following problems.

As in the related art, in the case where fail-safety of a braking means of the elevator apparatus is ensured by providing a plurality of computers, a probability of occurrence of a failure in any of the computers increases because of the presence of the multiple computers. In addition, braking is applied immediately after the detection of the failure, and hence a possibility of confinement of a passenger in a car also increases. Although the confinement of the passenger itself does no harm to the passenger, the confinement has a significant psychological impact on the passenger.

The present invention has been made to solve the problems as described above, and has an object of providing an elevator apparatus capable of effecting proper braking control of a car according to a detected content of a failure without providing a plurality of failure detection circuits.

Means for Solving the Problems

An elevator apparatus according to the present invention includes: a semiconductor switch which is connected in series to a brake coil for applying a braking force to a car, and which is capable of varying a current flowing through the brake coil; an interruption switch which is connected in series to the brake coil and the semiconductor switch, and which is capable of interrupting a current flowing through the brake coil; a braking force control processing means for controlling an amount of a current flowing through the semiconductor switch according to a deceleration of the car when the car stops; a failure detection section for detecting a failure in the braking force control processing means; a critical event detection means for detecting a critical event requiring an urgent stop of the car based on a state detection signal; and a brake power supply interrupting means for turning the interruption switch into an OFF state to apply braking when the failure is detected by the failure detection section and when the critical event is detected by the critical event detection means.

Effects of the Invention

According to the present invention, the control of the braking force according to a deceleration of the car is effected. Further, only when the failure is detected in the braking force control processing means and, in addition, a critical event such as running of the car out of control or running with a door open occurs, the power supply to the brake coil is immediately interrupted. As a result, the elevator apparatus can be obtained which is capable of effecting the proper braking control of the car according to the detected content of the failure.

BEST MODE FOR CARRYING OUT THE INVENTION

Figure 1:
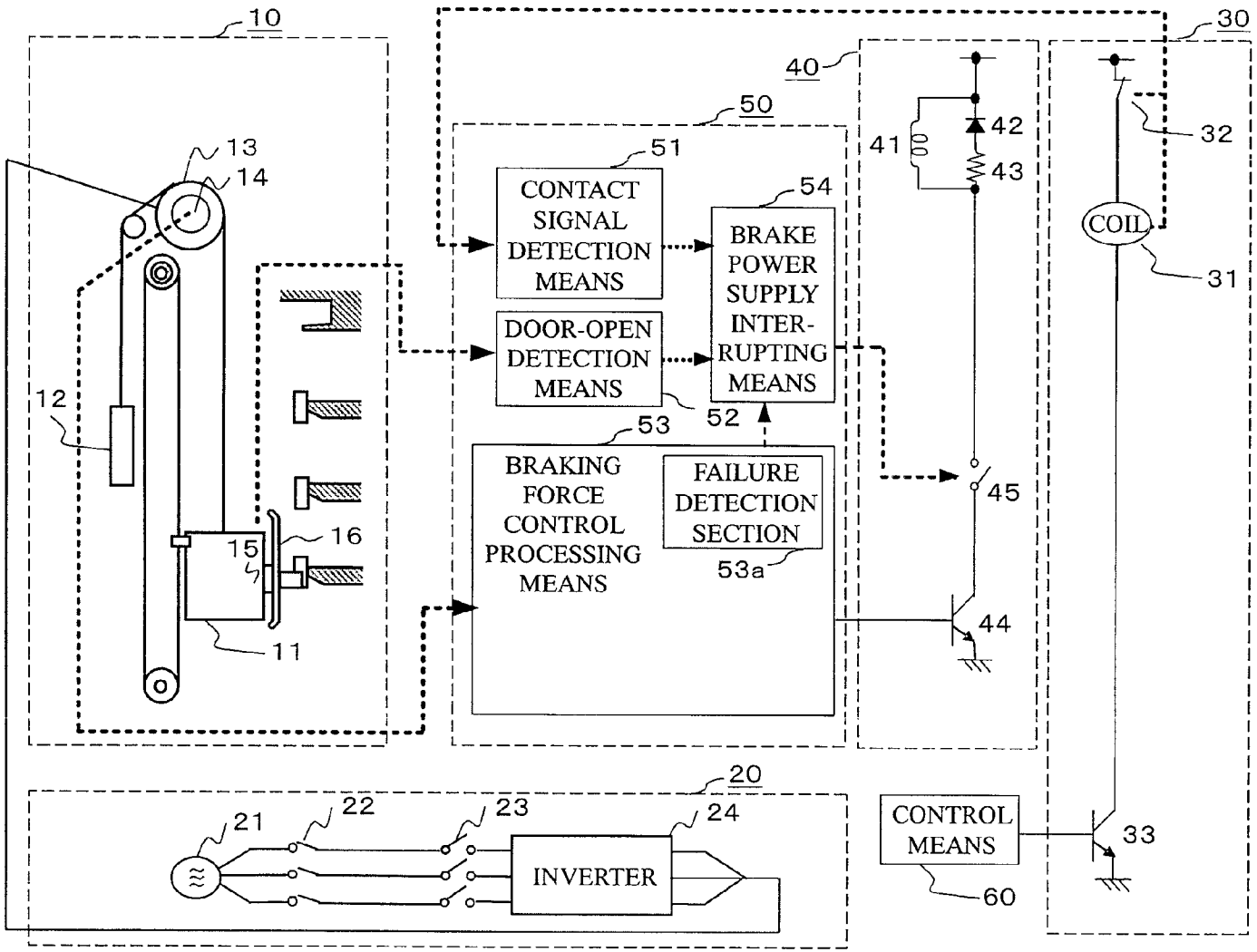
FIG. 1 is an overall configuration diagram of an elevator apparatus according to a first embodiment of the present invention.

Hereinafter, preferred embodiments of an elevator apparatus according to the present invention are described referring to the drawings.

First Embodiment

FIG. 1 is an overall configuration diagram of an elevator apparatus according to a first embodiment of the present invention, which includes a mechanical mechanism section 10, a hoisting machine driver circuit section 20, a contactor driver circuit section 30, a brake circuit section 40, a brake circuit control section 50, and a control means 60. Here, the control means 60 is a controller for effecting control of the raising and lowering of an elevator. Next, the functions of the above-mentioned sections and means are described.

The mechanical mechanism section 10 includes a car 11, a weight 12, a hoisting machine 13, an encoder 14, a car-side door 15, and a landing-side door 16. The weight 12 for balancing the car 11 is coupled to the car 11 by a main rope. The hoisting machine 13 is coaxially connected to a drive sheave (not shown) to rotationally driving the drive sheave. The encoder 14 is connected to the hoisting machine 13 to generate a speed signal indicating a speed of the sheave. Moreover, as doors for allowing a passenger to ride on and ride off the car 11, both the car-side door 15 and the landing-side door 16 are controlled to be opened and closed by the control means 60.

Next, the hoisting machine driver circuit section 20 includes an external power source 21, an electromagnetic breaker 22, an electromagnetic contactor 23, and an inverter 24. The hoisting machine 13 is connected to the hoisting machine driver circuit section 20 having the configuration as described above to be subjected to driving control.

Next, the contactor driver circuit 30 includes an electromagnetic contactor driving coil 31, an overspeed detection means 32, and a semiconductor switch 33. The electromagnetic contactor driving coil 31 is excited when the overspeed detection means 32 is in an ON state indicating that the overspeed detection means is not in an overspeed state but is normal and the semiconductor switch 33 controlled by the control means 60 is also in an ON state indicating that a control state is normal.

Then, the electromagnetic contactor 23 in the hoisting machine driver circuit section 20 described above is driven to be turned ON/OFF by excitation/de-excitation of the electromagnetic contactor driving coil 31 and is capable of interrupting power supplied to the hoisting machine 13 as necessary.

Next, the brake circuit section 40 includes a brake coil 41, a discharge diode 42, a discharge resistor 43, a semiconductor switch 44, and an interruption switch 45. The brake coil 41 is wired in parallel to a serial wiring of the discharge diode 42 and the discharge resistor 43. An end of the series-parallel circuit is connected to a power source, whereas the other end is connected to a ground side through the semiconductor switch 44 and the interruption switch 45.

Here, the semiconductor switch 45 is connected in series to the brake coil 41 and is capable of varying a current flowing through the brake coil 41. Specifically, the configuration is such that the current flowing through the brake coil 41 can be interrupted by the interruption switch 45 and can be controlled according to an operation of the semiconductor switch 45. Then, the semiconductor switch 44 is connected to a braking force control processing means 53 described below to be controlled thereby, whereas the interruption switch 45 is connected to a brake power supply interrupting means 54 described below to be controlled thereby.

Next, the brake circuit control section 50 includes a contact signal detection means 51, a door-open detection means 52, the braking force control processing means 53, and the brake power supply interrupting means 54. The braking force control processing means 53 includes a failure detection section 53*a*. Here, the contact signal detection means 51 and the door-open detection means 52 correspond to a critical event detection means. A technical feature of the present invention resides in the function of the brake circuit control section 50. Hereinafter, an operation thereof is described in detail.

The contact signal detection means 51 detects a contact signal of the overspeed detection means 32 or an auxiliary contact signal of the electromagnetic contactor driving coil 31. Moreover, the door-open detection means 52 detects open states of the car-side door 15 and the landing-side door 16.

Moreover, the braking force control processing means 53 judges from a speed and a deceleration of the car, which are calculated based on the speed signal generated by the encoder 14, whether or not control for the deceleration is required, and then, adjusts the amount of current flowing through the semiconductor switch 44.

More specifically, when the braking force control processing means 53 judges from the speed and the deceleration of the car that the deceleration is excessively large at the time of an emergency stop or the like, the amount of current flowing through the semiconductor switch 44 is adjusted to supply a desired amount of power to the brake coil 41 to reduce the amount of a braking operation.

On the other hand, the failure detection section 53 detects the presence/absence of a failure in the braking force control processing means 53 and outputs a failure signal to the brake power supply interrupting means 54 upon detection of the failure. The failure detection section 53*a* may be configured as a part of the braking force control processing means 53 or as a device present outside the braking force control processing means 53.

Here, the critical event in the failure of the braking force control processing means 53 corresponding to the function of controlling the braking force includes: 1) collision of the car against a terminal of a hoistway to harm a passenger because braking for an emergency stop does not work when the car runs out of control, and 2) fear that the passenger may be caught between a wall and a floor because the braking for the emergency stop does not work at the time of detection of running with the door open.

In other words, even if the failure in the braking force control processing section 53 is detected by the failure detection section 53*a*, the critical event does not occur except for when the car runs out of control and at the time of the running with door open. Specifically, if the failure occurs in the braking force control processing means 53, the critical events as described above do not occur even when a travel of the car is continued except for the case where the car approaches the terminal of the hoistway and the case where the running with the door open is detected.

Therefore, only when at least one of the contract signal of the overspeed detection means 32 (specifically, corresponding to the state where the car is running out of control) to be detected by the contact signal detection means 51, the auxiliary contact signal of the electromagnetic contactor driving coil 31, and the running with the door open to be detected by the door-open detection means 52 is detected upon detection of the failure signal from the failure detection section 53*a*, the braking power-off means 54 opens the interruption switch 45 to interrupt the power supply to the brake coil 41.

With the configuration as described above, the brake power supply interrupting means 54 is capable of controlling ON/OFF of the interruption switch 45 based on the results of detection for the occurrence/non-occurrence of the critical event in the case where the failure occurs in the braking force control processing means 53. As a result, even if the failure occurs in the braking force control processing means 53, the braking is not applied immediately in the case where the critical event does not occur. Therefore, the passenger can be prevented from being confined in the car.

The brake power supply interrupting means 54 is not required to perform complicated processing such as a calculation based on the signal from the encoder 14 and the adjustment of the amount of control on the semiconductor switch 44, which are effected by the braking force control processing means 53. Further, it is sufficient that the brake power supply interrupting means 54 is configured to perform processing merely for opening the interruption switch 45 based on the signals from the contact signal detection means 51, the door-open detection means 52, and the braking force control processing means 53. As a result, the brake power supply interrupting means 54 can be configured with a small number of components, thereby reducing cost of development and a failure rate.

As described above, according to the first embodiment, the control of the braking force according to the deceleration of the car can be effected. In addition, in the case where the failure is detected in the braking force control processing means, the power supply to the brake coil can be immediately interrupted only when the critical event such as the running of the car out of control or the running with the door open also occurs.

As a result, even when the failure occurs in the braking force control processing means, the braking is not immediately applied to prevent the car from being suddenly stopped in the case where the critical event does not occur. Therefore, the passenger can be prevented from being confined in the car. On the other hand, when the failure occurs in the braking force control processing means and, in addition, the critical event occurs, the power supply to the brake coil is immediately interrupted to bring the car to an urgent stop.

The encoder 14 connected not to the hoisting machine 13 but to a governor may be used. Moreover, the brake power supply interrupting means 54 may control the interruption switch 45 also based on information of a hoistway switch for detecting the terminals of the hoistway.

Second Embodiment

Figure 2:
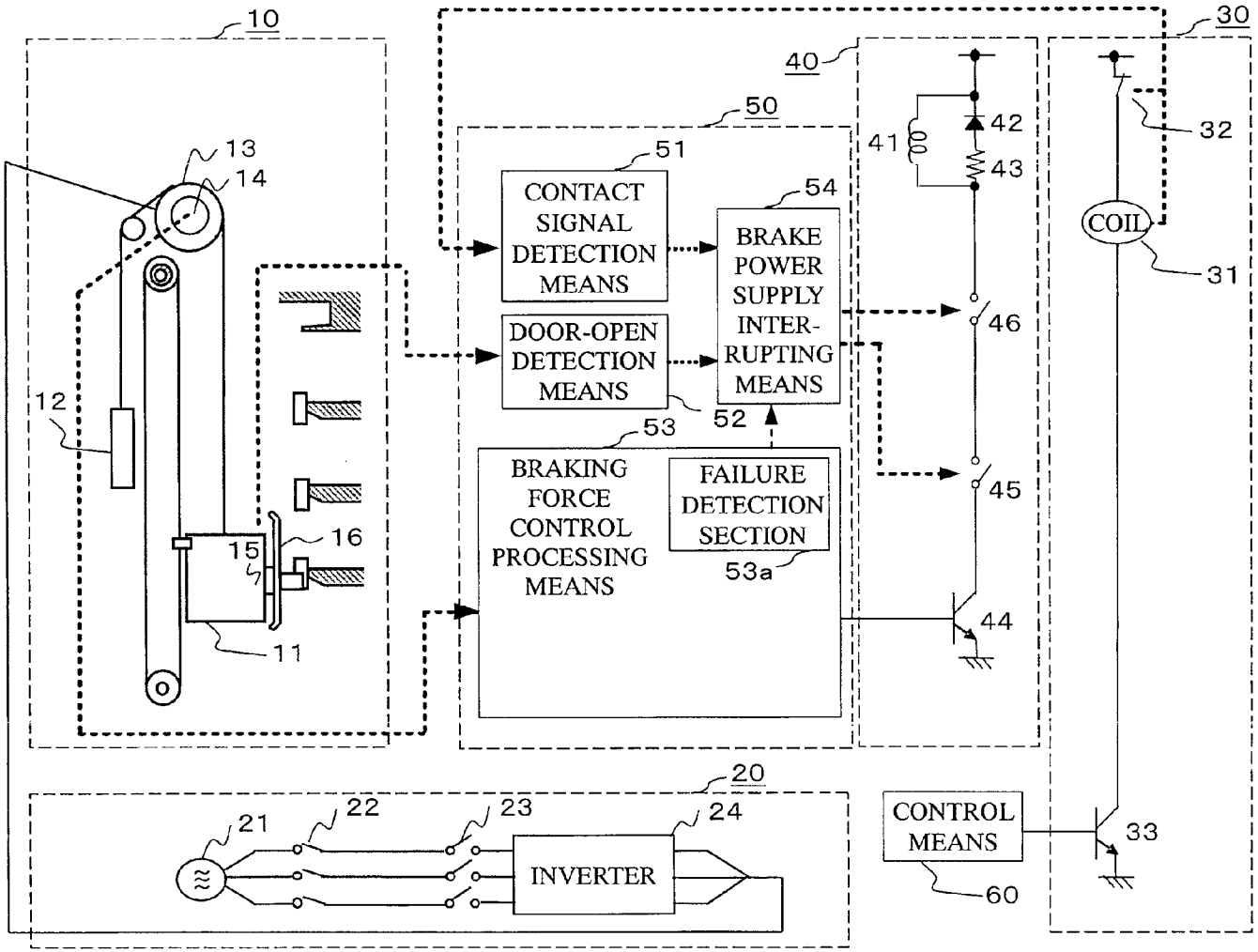
FIG. 2 is an overall configuration diagram of the elevator apparatus according to a second embodiment of the present invention.

FIG. 2 is an overall configuration diagram of the elevator apparatus according to a second embodiment of the present invention. In comparison with the configuration illustrated in FIG. 1 of the first embodiment described above, the configuration of FIG. 2 differs therefrom in that the brake circuit section 40 further includes a second interruption switch 46 and the brake power supply interrupting means 54 also controls ON/OFF of the second interruption switch 46.

The brake power supply interrupting means 54 in this second embodiment further has a timer function and is capable of controlling the second interruption switch 46 which is capable of interrupting the power supplied to the brake coil 41 after elapse of a predetermined time period from the reception of the failure signal from the failure detection section 53*a*.

Now, upon detection of the failure of the braking force control processing means 53 by the failure detection section 53*a*, the brake power supply interrupting means 54 receives the failure signal to start counting the timer and opens the second interruption switch 46 after elapse of a predetermined time period (for example, about several minutes) to interrupt the power supply to the brake coil 41, thereby bringing the car to the emergency stop.

With such a configuration, an operation time period, in which the brake power supply interrupting means 54 controls the interruption switch 45 based on judgement of the critical event, can be limited. As a result, it is possible to prevent a state where the power supply to the brake coil 41 cannot be interrupted as a result of the failure of the function of controlling the interruption switch 45 by the brake power supply interrupting means 54 in addition to the occurrence of the failure of the braking force control processing means 53. When the failure signal is detected, it is possible to reliably interrupt the power supply to the brake coil 41 after elapse of the predetermined time period.

As described above, according to the second embodiment of the present invention, there is provided the function of applying braking after elapse of the predetermined time period from the detection of the failure in the braking force control processing means regardless of the occurrence of the critical event. As a result, in the state where the failure is detected in the braking force control processing means but with the judgment of non-occurrence of the critical event, the state where the interruption of the power supply to the brake coil cannot be performed is prevented from continuing for a long time period.

As a result, even when some failure occurs in the control circuit for interrupting the power supply to the brake coil based on judgment of the critical event by the brake power supply interrupting means in the case where the failure in the braking force control processing means is detected, it is ensured that the braking is applied after elapse of the predetermined time period from the detection of the failure of the braking force control processing means. As a result, the brake interruption function can be diversified.

The function of effecting the ON/OFF control of the second interruption switch 46 as described above may be configured to be independent of the brake power supply interrupting means 54 without being provided in the brake power supply interrupting means 54 to receive the failure signal from the failure detection section 53*a*.

Third Embodiment

Figure 3:
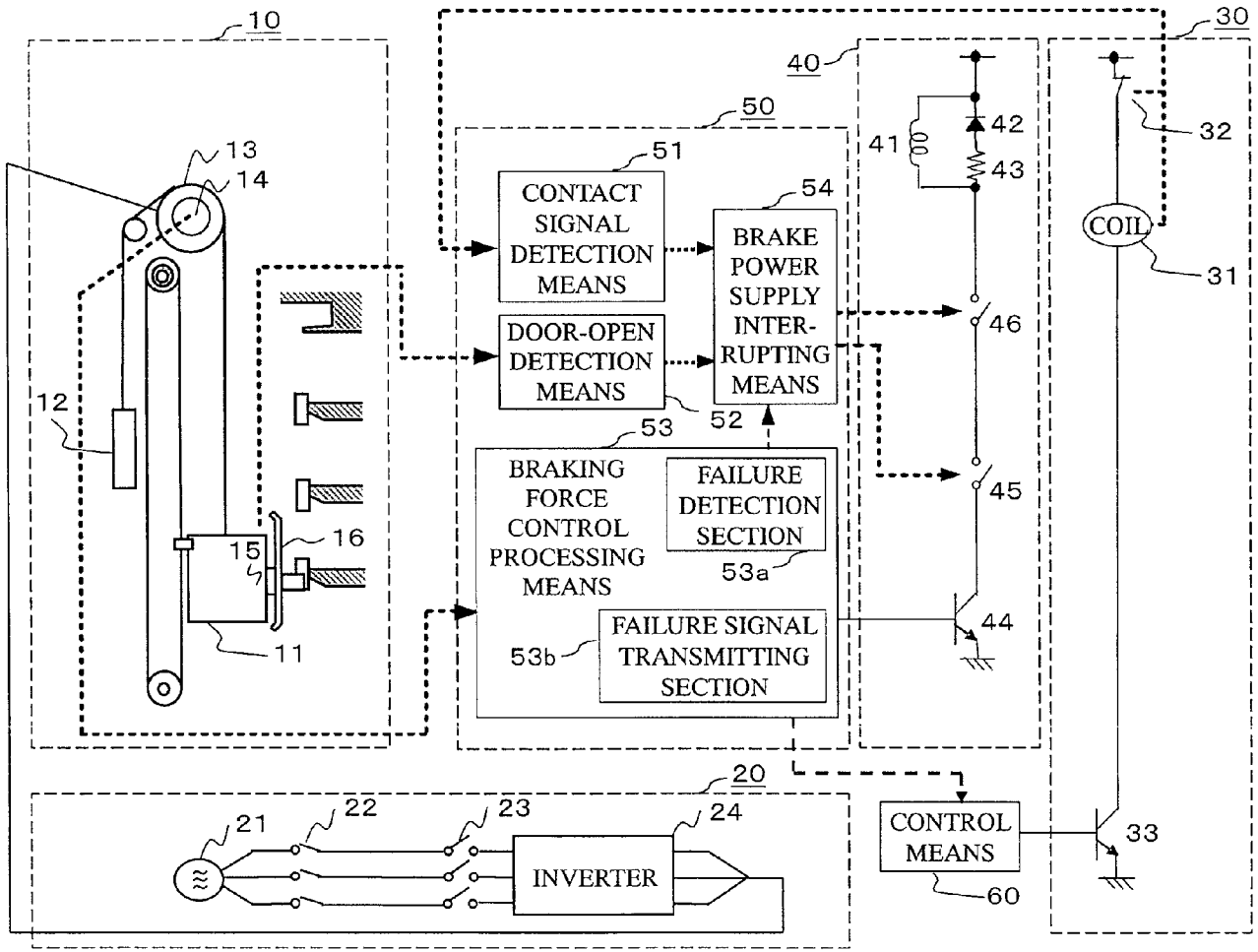
FIG. 3 is an overall configuration diagram of the elevator apparatus according to a third embodiment of the present invention.

FIG. 3 is an overall configuration diagram of the elevator apparatus according to a third embodiment of the present invention. In comparison with the configuration illustrated in FIG. 2 of the second embodiment described above, the configuration of FIG. 3 differs therefrom in that the braking force control processing means 53 further includes a failure signal transmitting section 53*b*.

The failure signal transmitting section 53*b* transmits a failure signal for notifying the detection of the failure to the control means 60 for the car upon detection of the failure in the braking force control processing means 54 by the failure detection section 53*a*. Upon reception of the failure signal, the control means 60 for the car stops the car at the nearest floor to evacuate the passenger from the car, and then, stops the service. Alternatively, failure information can be recorded in a log.

With such a configuration, an operation time period, in which the brake power supply interrupting means 54 controls the interruption switch 45 based on judgement of the critical event, can be limited. As a result, it is possible to prevent the continuation of a state where the power supply to the brake coil 41 cannot be interrupted as a result of the failure of the function of controlling the interruption switch 45 by the brake power supply interrupting means 54 in addition to the occurrence of the failure of the braking force control processing means 53. When the failure signal is detected, proper control of the raising and lowering of the car by the control means 60 can be effected.

As described above, according to the third embodiment of the present invention, there is provided the function of transmitting the information indicating the detection of the failure in the braking force control processing means to the control means which effects the control of the raising and lowing regardless of the occurrence of the critical event. As a result, in the state where the failure is detected in the braking force control processing means but with the judgment of non-occurrence of the critical event, the state where the interruption of the power supply to the brake coil cannot be performed is prevented from continuing for a long time period. Therefore, with the detection of the failure, proper control of the raising and lowering by the control means can be effected.

As a result, when the failure occurs in the braking force control processing means, not only the function of the brake circuit control section 50 but also the function of the control device is utilized to stop the car at the nearest floor to enable the evacuation of the passenger.

The failure signal transmitting section 53*b* may be configured as a part of the braking force control processing means 53 or as a device present outside the braking force control processing means 53.

The function of the failure detection section 53*a* described in the first to third embodiments can also be configured as a dual system as described in the related art as measures to improve the reliability of a failure detection function.

Although the case where the power supply to the brake coil 41 is interrupted by the brake power supply interrupting means 54 has been described as a method of bringing the car to the emergency stop in response to the critical event in the first to third embodiments described above, the present invention is not limited thereto. For example, as another method of bringing the car to the emergency stop in response to the critical event, the mechanical forced stop of the car is also considered. With use of the braking force control processing means, the effects equivalent to those in the first to third embodiments described above can be obtained.

The invention claimed is:

1. An elevator apparatus, comprising:

a semiconductor switch connected in series to a brake coil for applying a braking force to a car, the semiconductor switch being for varying a current flowing through the brake coil;

an interruption switch which is connected in series to the brake coil and the semiconductor switch and is capable of interrupting a current flowing through the brake coil;

a braking force control processing means for controlling an amount of a current flowing through the semiconductor switch according to a deceleration of the car when the car stops;

a failure detection section for detecting a failure in the braking force control processing means;

a critical event detection means for detecting a critical event requiring an urgent stop of the car based on a state detection signal; and a brake power supply interrupting means for turning the interruption switch into an OFF state to apply braking when the failure is detected by the failure detection section and when the critical event is detected by the critical event detection means.

2. The elevator apparatus according to claim 1, wherein the critical event detection means loads an overspeed detection signal of the car, an open-state detection signal of a contactor inserted into a driver circuit section for a hoisting machine for raising and lowering the car, and a door-open detection signal as the state detection signal, and detects occurrence of the critical event by loading at least any one of the detection signals.

3. The elevator apparatus according to claim 1, further comprising a second interruption switch which is connected in series to the brake coil, the semiconductor switch and the interruption switch and is capable of interrupting the current flowing through the brake coil, wherein the brake power supply interrupting means turns the second interruption switch into an OFF state to apply the braking when a predetermined time period elapses from the detection of the failure by the failure detection section.

4. The elevator apparatus according to claim 1, further comprising a failure signal transmitting section for transmitting a failure signal to a control device for effecting control of raising and lowering of the car when the failure in the braking force control processing means is detected by the failure detection section.

5. The elevator apparatus according to claim 2, further comprising a second interruption switch which is connected in series to the brake coil, the semiconductor switch and the interruption switch and is capable of interrupting the current flowing through the brake coil, wherein the brake power supply interrupting means turns the second interruption switch into an OFF state to apply the braking when a predetermined time period elapses from the detection of the failure by the failure detection section.

6. The elevator apparatus according to claim 2, further comprising a failure signal transmitting section for transmitting a failure signal to a control device for effecting control of raising and lowering of the car when the failure in the braking force control processing means is detected by the failure detection section.

7. The elevator apparatus according to claim 3, further comprising a failure signal transmitting section for transmitting a failure signal to a control device for effecting control of raising and lowering of the car when the failure in the braking force control processing means is detected by the failure detection section.

8. The elevator apparatus according to claim 5, further comprising a failure signal transmitting section for transmitting a failure signal to a control device for effecting control of raising and lowering of the car when the failure in the braking force control processing means is detected by the failure detection section.

* * * * *